US011415934B2

(12) United States Patent
Deocon Mir et al.

(10) Patent No.: US 11,415,934 B2
(45) Date of Patent: Aug. 16, 2022

(54) AEROSOL MANAGEMENT SYSTEMS

(71) Applicant: Hewlett-Packard Development Company, L.P., Spring, TX (US)

(72) Inventors: Javier Deocon Mir, Sant Cugat del Valles (ES); Francisco Guerrero Carvajal, Sant Cugat del Valles (ES); Diego Lopez Ubieto, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/417,215

(22) PCT Filed: Jul. 16, 2019

(86) PCT No.: PCT/US2019/041932
§ 371 (c)(1),
(2) Date: Jun. 22, 2021

(87) PCT Pub. No.: WO2021/010983
PCT Pub. Date: Jan. 21, 2021

(65) Prior Publication Data
US 2022/0137553 A1 May 5, 2022

(51) Int. Cl.
*G03G 21/20* (2006.01)

(52) U.S. Cl.
CPC ..... *G03G 21/206* (2013.01)

(58) Field of Classification Search
CPC ..... G03G 21/206; G03G 2221/1645; B41J 2/145; B41J 29/377
See application file for complete search history.

(56) References Cited

U.S. PATENT DOCUMENTS

| | | | | |
|---|---|---|---|---|
| 5,774,141 | A | 6/1998 | Cooper et al. | |
| 6,962,403 | B2 | 11/2005 | Smith et al. | |
| 7,357,479 | B2 | 4/2008 | Brugue et al. | |
| 7,979,152 | B2 | 7/2011 | Davidson | |
| 8,388,102 | B2 | 3/2013 | Urbistondo et al. | |
| 9,315,037 | B2 | 4/2016 | Gasso Puchal et al. | |
| 2011/0007113 | A1* | 1/2011 | Katano | B41J 29/12 347/40 |
| 2017/0080731 | A1* | 3/2017 | Miller | A43B 3/0078 |
| 2018/0022127 | A1 | 1/2018 | Roure Pastor et al. | |

FOREIGN PATENT DOCUMENTS

| | | | |
|---|---|---|---|
| CN | 108729055 | A | 11/2018 |
| JP | 08238784 | A | 9/1996 |

* cited by examiner

*Primary Examiner* — Hoang X Ngo
(74) *Attorney, Agent, or Firm* — HP Inc. Patent Department

(57) ABSTRACT

Disclosed herein is a device, a printing device and a method of operating a printing device. The device comprises an air flow path extending from an intake to an outlet. The intake is to be mounted in a printing device and comprises a proximal intake segment and a distal intake segment along the air flow path. A proximal air flow path from the proximal intake segment to the outlet is shorter than a distal air flow path from the distal intake segment to the outlet. Each of the proximal and distal intake segments comprises a wall segment with at least one hole. An opening ratio of an area of the at least one hole and an area of the respective wall segment is larger in the distal intake segment than in the proximal intake segment.

15 Claims, 10 Drawing Sheets

AEROSOL MANAGEMENT SYSTEMS

BACKGROUND

A printing device such as a large format printer may generate aerosol due to partial disintegration of printing fluid ejected from a print head of the printing device. The aerosol may contaminate the printing device and its environment, which may affect print quality and may cause failure of the printing device.

BRIEF DESCRIPTION OF DRAWINGS

In the following, a detailed description of various examples is given with reference to the figures. The figures show schematic illustrations of FIG. 1*a*: a front view of a device with an intake and an outlet according to an example.

DETAILED DESCRIPTION

Aerosol may for example be generated in a printing device when performing maintenance operations on a print head of the printing device or when printing on a print medium, in particular a porous print medium such as a textile. The aerosol may deposit within the printing device, e.g. on a surface that comes in contact with the print medium or a nozzle plate of the print head. This may lead to deterioration in print quality and may even cause failure of the printing device, e.g. when an electrical connection is interrupted due to aerosol accumulating on an electrical contact in the printing device. To avoid contamination of the printing device, aerosol may be extracted from a maintenance zone or a printing zone of the printing device, e.g. by generating an air flow in the printing device. The air flow may be filtered to remove aerosol from the air, e.g. before releasing the air back into the printing device or the environment of the printing device or before releasing the air from a room that the printing device is placed in.

Figure 1A:
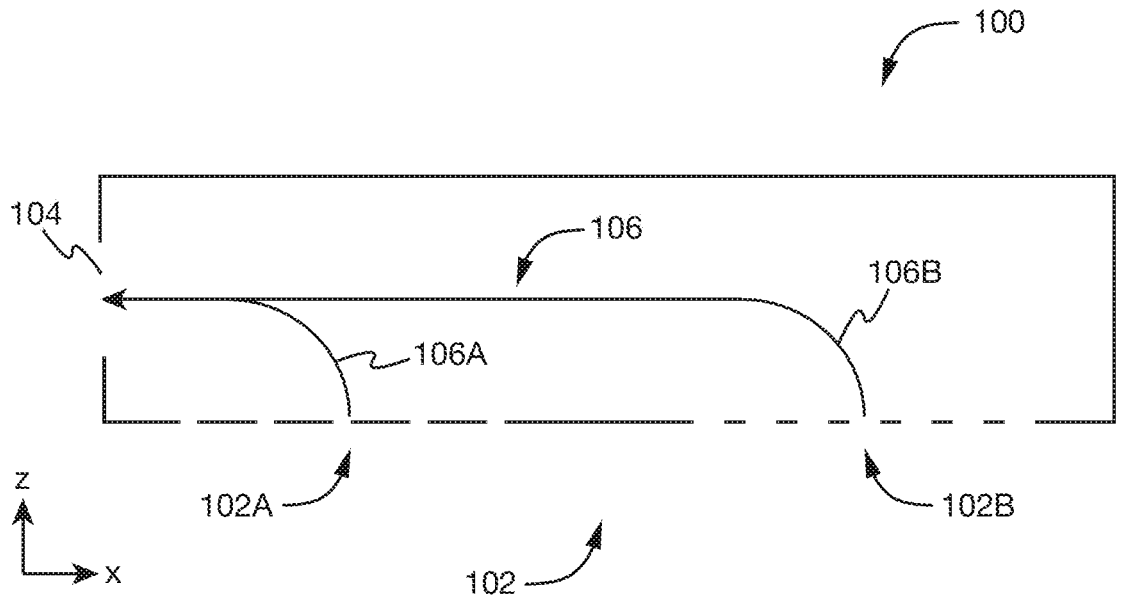
FIG. 1*b*: a bottom view of the device of FIG. 1*a* in accordance with an example.
Figure 1B:
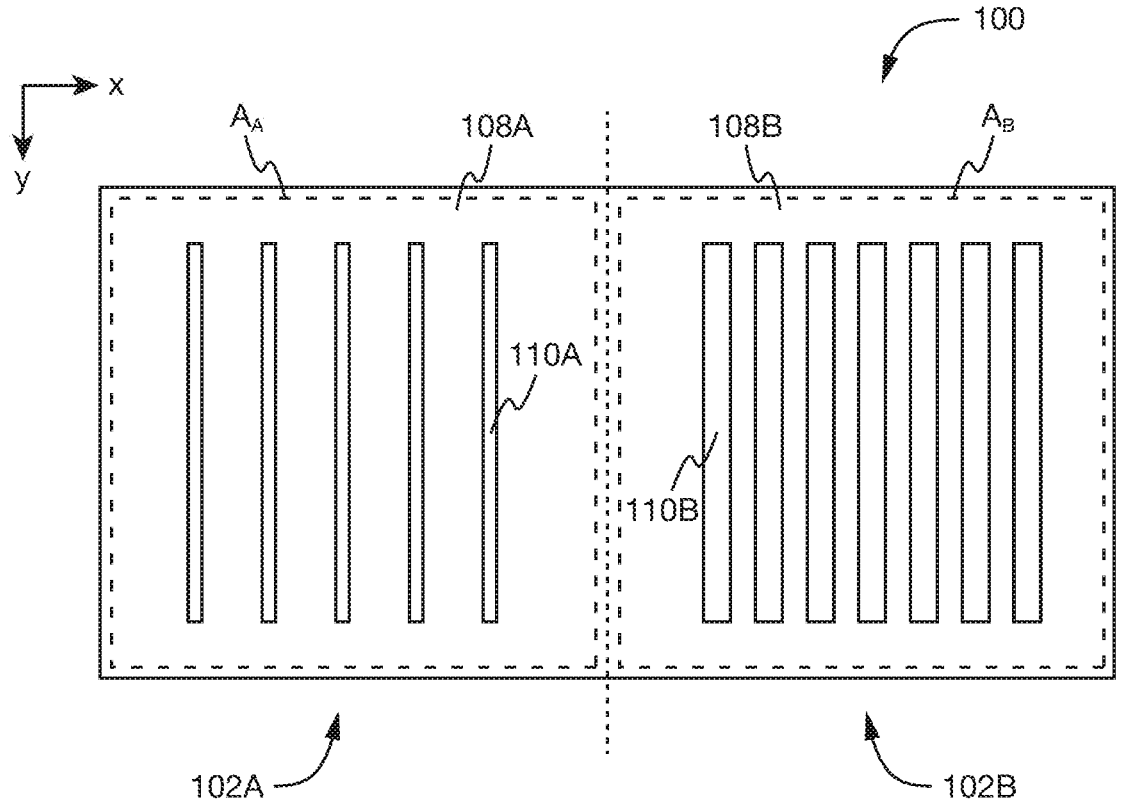

FIGS. 1*a* and 1*b* depict a front and bottom view, respectively, of a device 100 in accordance with an example. The device 100 comprises an intake 102 and an outlet 104, which are connected by an air flow path 106. The air flow path 106 may for example be the path along which air flows from the intake 102 to the outlet 104 when extracting air through the outlet 104. The intake 102 and/or the device 100 are to be mounted in another device, for example a printing device (not shown) such as a large format printer, e.g. a large format textile printer as discussed below with reference to FIGS. 4*a*, 4*b* and 6*a*, 6*b*. For example, the intake 102 may be mounted such that the intake 102 faces a printing zone and/or a maintenance zone of the printing device.

The intake 102 comprises a proximal intake segment 102A and a distal intake segment 102B along the air flow path 106. A proximal air flow path 106A from the proximal intake segment 102A to the outlet 104 is shorter than a distal air flow path 106B from the distal intake section 102B to the outlet 104. The proximal air flow path 106A may for example be the path along which air flows from the proximal intake segment 102A to the outlet 104 when extracting air through the outlet 104. Accordingly, the distal air flow path 106B may for example be the path along which air flows from the distal intake segment 102B to the outlet 104 when extracting air through the outlet 104. In the context of the present disclosure, the terms "proximal" and "distal" may for example be used in relation to the outlet 104, i.e. a proximal element or position may be closer to the outlet 104 than a distal element and position, respectively.

The proximal intake segment 102A and the distal intake segment 102B may each comprise a wall segment 108A and 108B, respectively. The wall segments 102A, 102B may for example be segments of a physical boundary separating the air flow path 106 from an environment of the device 100, e.g. from the interior of a printing device. The physical boundary may for example be a wall or a grid or mesh. The wall segments 102A, 102B may for example be adjacent segments of a bottom wall of the device 100 as shown in FIG. 1*b*, where a border between the segments is indicated by the straight dashed line. In other examples, the wall segments 102A, 102B may be segments of different walls, e.g. a bottom wall and a side wall of the device 100, and/or additional segments, for example additional intake segments, may be arranged between the wall segments 102A, 102B, e.g. as discussed below with reference to FIGS. 2*a* and 2*b*. In some examples, the wall segments 108A, 108B may have the same area.

Each of the wall segments 102A, 102B has at least one hole 110A and 110B, respectively. In the context of the present disclosure, a hole may for example be an element such as an opening or a through-hole that provides a fluid connection, e.g. between two opposing sides of a physical boundary. Accordingly, the at least one hole 110, 110B may provide a fluid connection between an environment of the device 100 and the air flow path 106. In some examples, a hole may comprise elements such as a filter or a permeable membrane, which may e.g. be arranged in a through-hole.

In the example shown in FIG. 1*b*, each of the wall segments 102A, 102B has a plurality of holes 110A, 110B, which may e.g. have a quadratic, rectangular, circular, elliptical or irregular shape. In other examples, at least one of the wall segments 102A, 102B may have one hole, e.g. a comb-like hole formed by connecting the plurality of holes 110A or 110B. The at least one hole 110A, 110B may be in fluid communication with the outlet 104 via the air flow path 106.

An opening ratio of the distal intake segment is larger than an opening ratio of the proximal intake segment 102A. In the context of the present disclosure, an opening ratio of an intake segment may for example denote a ratio of an area of the at least one hole 110A, 110B of the respective wall segment 108A, 108B and an area of the respective wall segment 108A, 108B. The area of a wall segment may for example be the area of the respective segment of a physical boundary separating the air flow path 106 from an environment of the device 100, e.g. the area $A_A$ and $A_B$, respectively, as indicated by the dashed rectangles in FIG. 1*b*. The area of the wall segment 108A, 108B may comprise a portion containing the at least one hole 110A, 110B and may additionally comprise a portion without holes, e.g. a portion of the physical boundary surrounding the at least one hole 110A, 110B. In some examples, the opening ratio of the proximal intake segment 102A, i.e. the ratio between the total area of hole(s) and the total area of a wall segment, may be no smaller than 5%, in one example no smaller than 10%, and/or may be no larger than 50%, in one example no larger than 30%. The opening ratio of the proximal intake segment 102A may e.g. be 15%. In some examples, the opening ratio of the distal intake segment 102B may be no smaller than 10%, in one example no smaller than 20%, and/or may be no larger than 75%, in one example no larger than 50%. The opening ratio of the distal intake segment 102B may e.g. be 30%.

The proximal intake segment 102A and the distal intake segment 102B may differ in at least one of a size of a hole, a density of holes and an arrangement of holes. In the example of FIG. 1*b*, the holes 110B in the wall segment 108B are both larger and denser than the holes 110A in the wall segment 102A. In other examples, the wall segment 108B may for example comprise holes 110B of the same size and inter-hole spacing as the wall segment 108A, but may comprise a larger number of holes. The holes 110A, 110B may be arranged in a regular pattern as in FIG. 1*b* or may be arranged in an irregular pattern.

By choosing the opening ratio in the proximal intake segment 102A and/or the distal intake segment 102B, the rate of air flow through the respective intake segment may be adjusted. In particular, when air is extracted through the outlet 104, a pressure difference across the proximal intake segment 102A may be larger than a pressure difference across the distal intake segment 102B due to the different lengths of the respective air flow paths 106A, 106B. The larger opening ratio in the distal intake segment may allow for achieving a similar air flow rate through both intake segments 102A, 102B.

In some examples, the opening ratios in the proximal and distal intake segments 102A, 102B may be chosen such that a flow rate through the distal intake segment 102B is no smaller than 75% and/or no larger than 125% of a flow rate through the proximal intake segment 102A when air is extracted through the outlet 104, thereby generating an air-extracting flow through the intake 102. Air may e.g. be extracted through the outlet 104 with a predetermined flow rate or by applying a predetermined pressure difference between the outlet 104 and the environment of the device 100 adjacent to the intake 102. In one example, the flow rate through the distal intake segment 102B may e.g. be no smaller than 90% and/or no larger than 110% of a flow rate through the proximal intake segment 102A. The flow rate through a segment may e.g. be the volume of air flowing through the respective segment per unit of time.

In other examples, the opening ratios in the proximal and distal intake segments 102A, 102B may be chosen such that, when air is extracted through the outlet 104, an area-normalized flow rate through the distal intake segment 102B is no smaller than 75% and/or no larger than 125% of an area-normalized flow rate through the proximal intake segment 102A. In one example, the area-normalized flow rate through the distal intake segment 102B may e.g. be no smaller than 90% and/or no larger than 110% of the area-normalized flow rate through the proximal intake segment 102A. The area-normalized flow rate through a segment may e.g. be the flow rate through the respective wall segment divided by the area of the respective wall segment.

In yet other examples, the opening ratios in the proximal and distal intake segments 102A, 102B may be chosen such that, when air is extracted through the outlet 104, a length-normalized flow rate through the distal intake segment 102B is no smaller than 75% and/or no larger than 125% of a length-normalized flow rate through the proximal intake segment 102A. In one example, the length-normalized flow rate through the distal intake segment 102B may e.g. be no smaller than 90% and/or no larger than 110% of the length-normalized flow rate through the proximal intake segment 102A. The length-normalized flow rate through a segment may e.g. be the flow rate through the respective wall segment divided by a length of the respective wall segment, e.g. the length of the respective wall segment along the air flow path or along a print head path of a printing device.

The opening ratios in the proximal and distal intake segments 102A, 102B may be chosen based on a pressure difference $\Delta p$ across the respective segments when applying a given pressure at the outlet 104. In one example, the opening ratio of a segment may be proportional to $1/\Delta p^{\alpha}$ with a positive exponent $\alpha>0$, e.g. inversely proportional to the respective pressure difference or the square root of the respective pressure difference. Additionally or alternatively, the opening ratios in the proximal and distal intake segments 102A, 102B may be chosen based on the length L of the corresponding air flow path 106A, 106B. In one example, the opening ratio of a segment may be proportional to $L^{\beta}$ with a positive exponent $\beta>0$, e.g. proportional to the length of the air flow path or the square of the length of the air flow path.

In some examples, the intake 102 may extend over at least 75%, in one example over at least 100%, of a width of a print medium of a printing device that the device 100 is to be mounted in and/or of a length of a print head path in a printing zone of a printing device that the device 100 is to be mounted in, e.g. as described below with reference to FIGS. 4*a* and 4*b*. A length of the intake 102 may for example be no smaller than 75% of a maximum print medium width accepted by the printing device. The length of the intake 102 may e.g. be the distance between a proximal end of the proximal intake segment 102A and the distal end of the distal segment 102B. In some examples, the intake 102 may be a continuous intake, i.e. the at least one holes 110A, 110B may be distributed and/or extend over substantially the entire width of the intake 102.

Figure 2A:
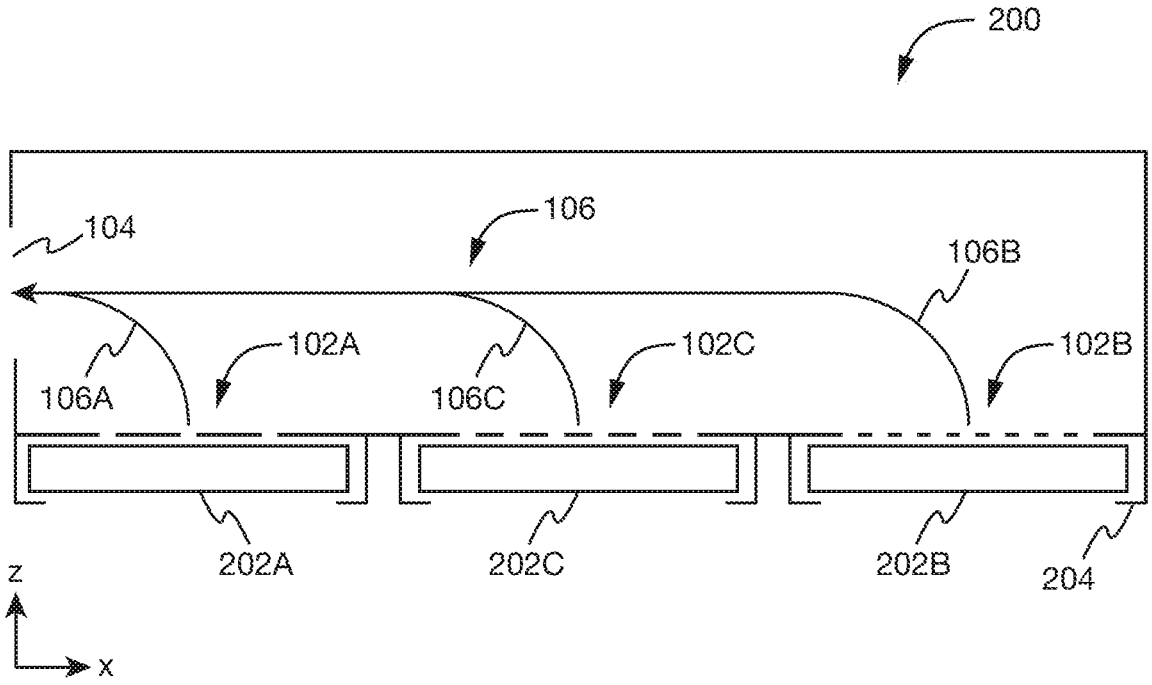
FIG. 2*a*: a front view of a device having an outlet and an intake with a proximal, central and distal intake segment according to an example.
Figure 2B:
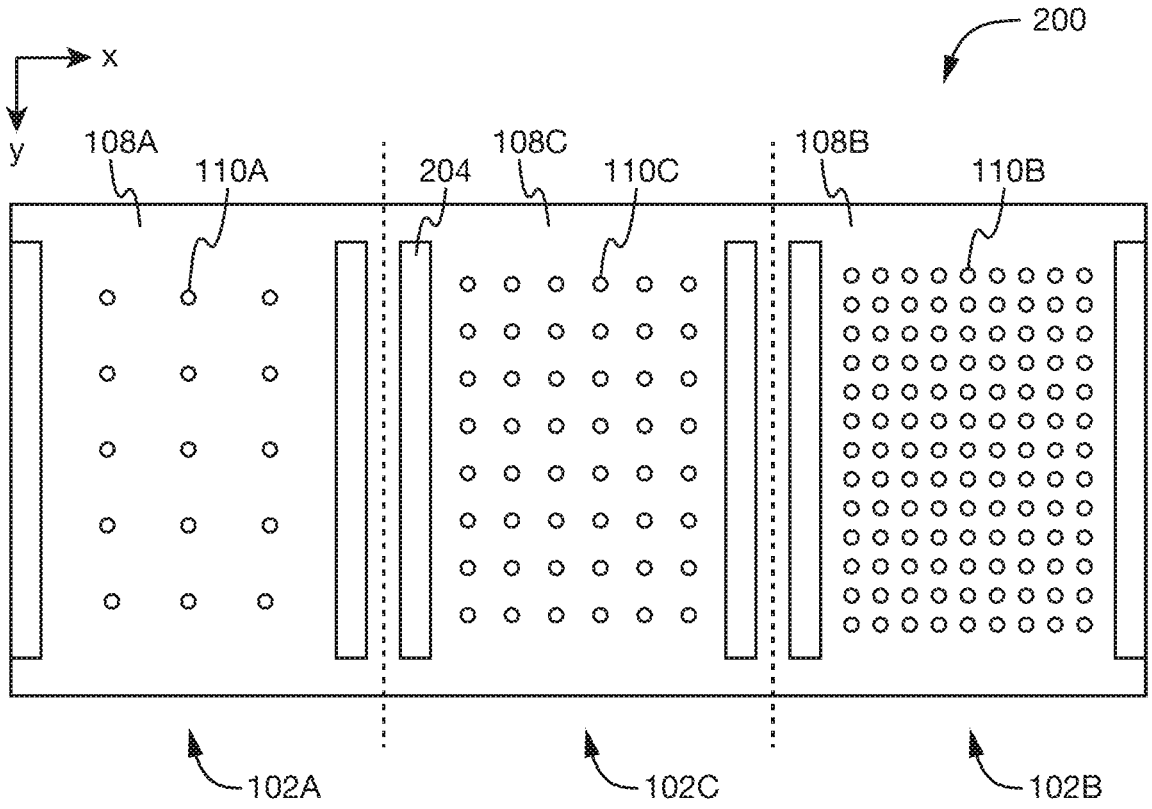
FIG. 2*b*: a bottom view of the device of FIG. 2*a* in accordance with an example.

FIGS. 2*a* and 2*b* depict a front and bottom view, respectively, of a device 200 according to another example. Similar to the device 100, the device 200 also comprises an intake 102 and an outlet 104 with an air flow path 106 extending from the intake 102 to the outlet 104.

The intake 102 of the device 200 comprises three intake segments: a proximal intake segment 102A, a central intake segment 102C and a distal intake segment 102B. Each of the intake segments is in fluid communication with the outlet 104 through the air flow path 106, which comprises a proximal air flow path 106A from the proximal intake segment 102A, a central air flow path 106C from the central intake segment 106C and a distal air flow path 106B from the distal intake segment 102B. The central air flow path 106C is shorter than the distal air flow path 106B, but longer than the proximal air flow path 106A.

Similar to the device 100, each of the intake segments 102A-102C comprises a wall segment 108A, 108B, and 108C, respectively, with at least one hole 110A, 110B, and 110C, respectively. The opening ratio in the central intake segment 108C may be larger than the opening ratio in the proximal intake segment 102A and may be smaller than the opening ratio in the distal intake segment 102B. The intake segments 102A-102C may differ in at least one of a size of a hole, a density of holes and an arrangement of holes.

In the example of FIG. 2*b*, each of the wall segments 108A-108C has a plurality of holes 110A-110C, which may e.g. each have a circular shape. A density of holes may be lowest in the proximal intake segment 102A and may be highest in the distal intake segment 102B. Additionally or alternatively, a size of the holes may be smallest in the proximal intake segment 102A and may be largest in the distal intake segment 102E. In other examples, each of the holes 110A-110C may have the same shape as in the example of FIG. 2*b*, which may facilitate fabrication of the device 200.

As described above for the device 100, the opening ratio of the intake segments 102A-102C may e.g. be chosen based on a pressure difference and/or air flow path length associated with the respective intake segment. In particular, the opening ratio of the intake segments 102A-102C may be chosen such that an air flow rate, an area-normalized air flow rate and/or a length-normalized air flow rate is the same or approximately the same in each intake segment. The air flow rates, area-normalized air flow rates and/or length-normalized air flow rates through the distal and central intake segments 102B, 102C may e.g. be no smaller than 75% and/or no larger than 125% of the respective quantity of the proximal intake segment 102A, in one example no smaller than 90% and/or no larger than 110% of the respective quantity of the proximal intake segment 102A.

In the example of FIGS. 2*a* and 2*b*, the outlet 104 is arranged in a left side wall of the device 200 as shown in FIG. 2*a*. Accordingly, intake segment 102A is closer to the outlet 104 than the intake segments 102B and 102C and thus constitutes the proximal intake segment, whereas the intake segment 102B is further away from the outlet 104 than the intake segments 102A and 102C and thus constitutes the distal intake segment. In other examples, the outlet 104 may be located at a different position and the proximal and/or distal intake segments may thus be different segments of the intake segments 102A-102C than in the example of FIGS. 2*a* and 2*b*. In one example, the outlet 104 may be arranged in a top wall of the device 200, e.g. in the center such that the outlet 104 opposes the intake segment 102C. In this example, the intake segment 102C may be closer to the outlet 104 than the intake segments 102A and 102B and may thus constitute the proximal intake segment, i.e. may have a smaller opening ratio than the distal intake segments 102A, 102B.

In some examples, the intake 102 may comprise more than three intake segments and may e.g. be made up of 4-10 intake segments. Each of the intake segments may be similar to the intake segments 102A-102C and may have a different opening ratio, wherein the opening ratio may e.g. increase with the length of the respective air flow path. Intake segments may for example be characterized by their opening ratio, a hole size, a hole density and/or a hole pattern. Accordingly, an intake segment may e.g. be distinguished from neighboring segments by at least one of the aforementioned quantities, for example the density of holes as in FIG. 2*b*. Additionally or alternative, the intake 102 may comprise blind segments without holes, which may e.g. be arranged between intake segments. The intake 102 may for example be divided in segments by virtual cuts perpendicular to the air flow path 106, i.e. the intake 102 may be made up from a plurality of segments arranged along the air flow path 106.

In the example of FIGS. 2*a* and 2*b*, the segments 102A-102C have the same size. In other examples, the segments 102A-102C may e.g. have different lengths along the air flow path and/or different widths perpendicular to the air flow path. In one example, the central intake segment 102C may e.g. be longer than the proximal and distal intake segments 102A, 102B. In another example, the distal intake segment 102B may e.g. be wider than the proximal intake segment 102A, which may further increase the air flow through the distal intake segment 102B.

The device 200 may further comprise a support structure, which is to receive and support an air filter such that the air filter can be removably attached adjacent to the intake 102. The support structure may be attached to the intake 102, e.g. to an outer wall of the intake 102 facing away from the outlet 104 along the air flow path 106. In the example of FIGS. 2*a* and 2*b*, the support structure comprises a pair of rails 204 for each of the intake segments 102A-102C, wherein each pair of rails 204 is to receive an air filter 202A, 202B, and 202C, respectively. When mounted, the air filters 202A-202C may be arranged directly in front of the respective intake segment such that air entering the device 200 through the intake segments 102A-102C first passes through one of the air filters 202A-202C. The air filters 202A-202C, which are not shown in FIG. 2*b* for simplicity, may e.g. be slid in and out of the rails 204 from the side and/or may be bent for inserting the filters 202A-202C in the rails. Thereby, the air filters 202A-202C may be exchanged easily, e.g. when approaching or reaching their filtering capacity. The air filters 202A-202C may be to absorb aerosol from air passing through the air filters 202A-202C. The air filters 202A-202C may for example comprise a porous or fibrous material, e.g. synthetic fibers such as polyester fibers or a polyurethane foam. In other examples, the number of filters may be different from the number of intake segments. In one example, there may e.g. be one filter that is to be arranged in front of each of the intake segments 102A-102C.

Figure 3A:
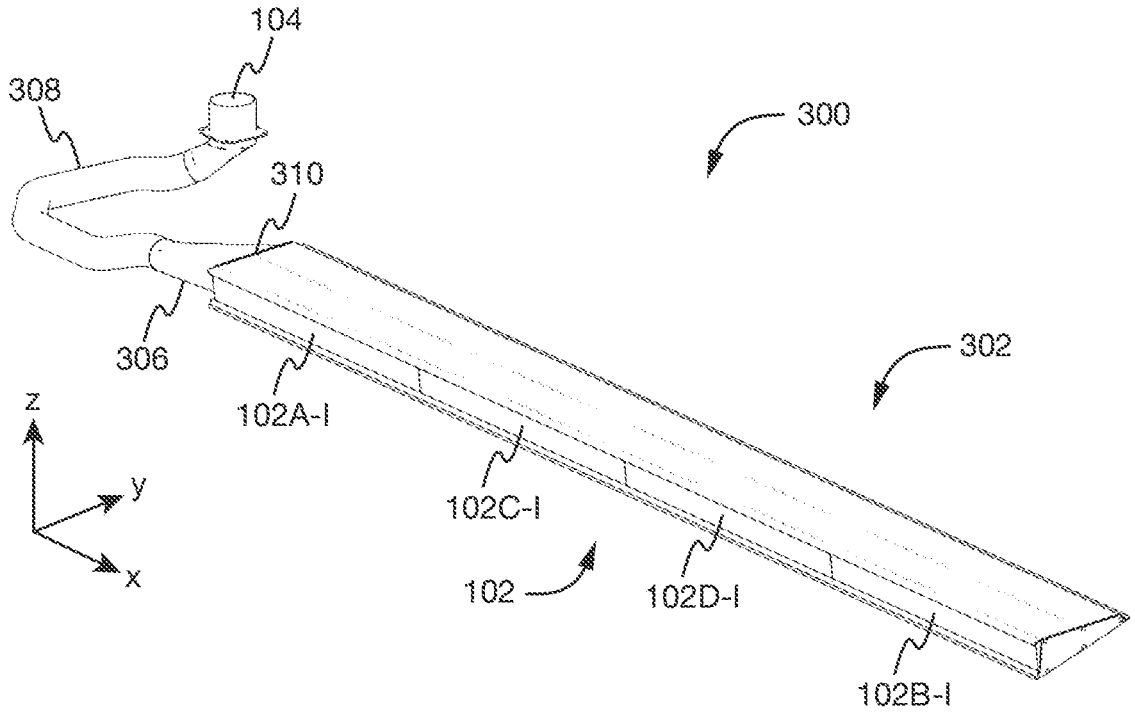
FIG. 3*a*: a perspective view of a device having an intake chamber and an outlet according to an example.
Figure 3B:
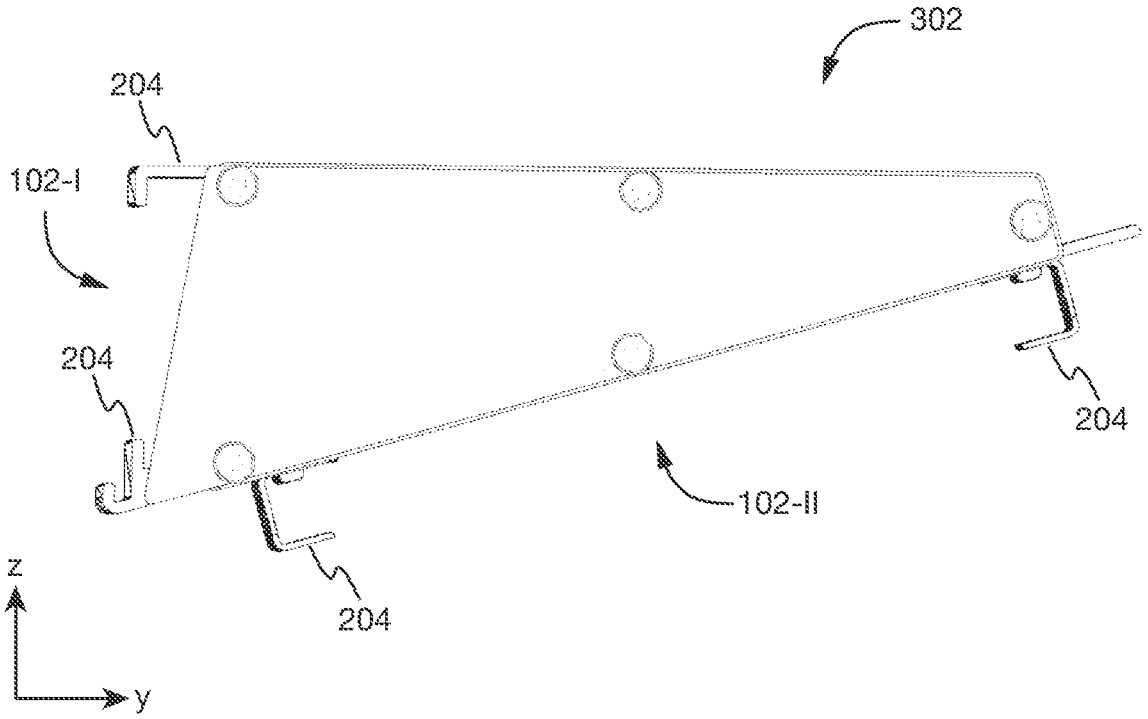
FIG. 3*b*: a side view of the intake chamber of the device of FIG. 3*a* in accordance with an example.
Figure 3C:
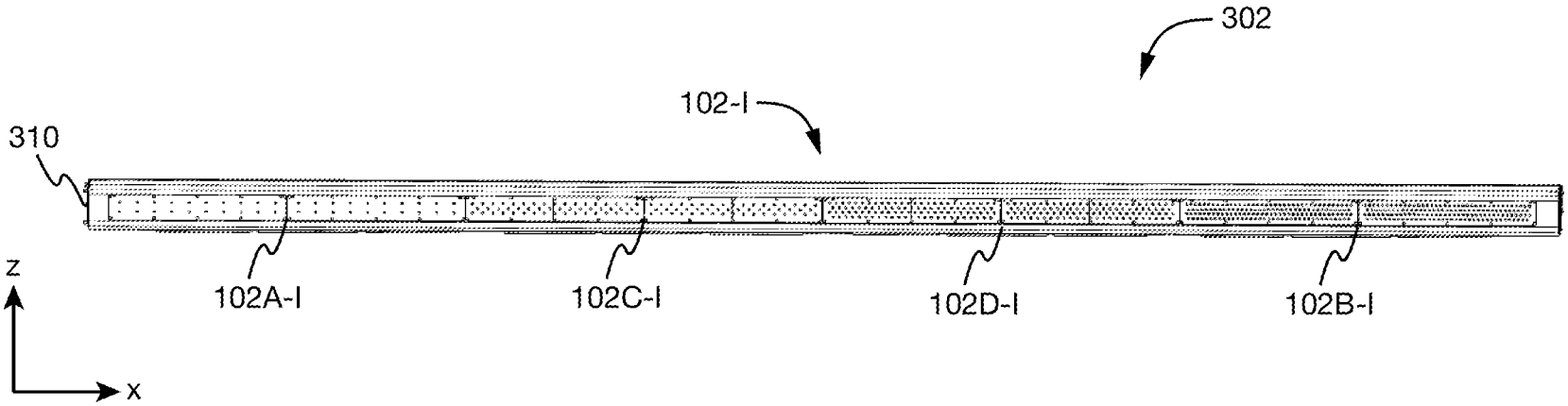
FIG. 3*c*: a front view of the intake chamber of the device of FIG. 3*a* in accordance with an example.
Figure 3D:
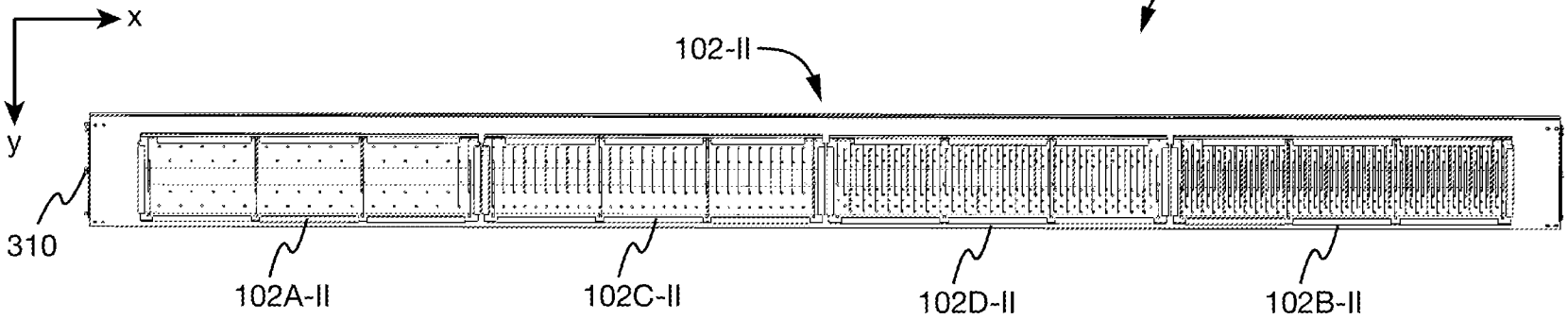
FIG. 3*d*: a bottom view of the intake chamber of the device of FIG. 3*a* in accordance with an example.

FIGS. 3*a* to 3*d* depict a device 300 in accordance with another example, which is shown in a perspective view in FIG. 3*a*. The device 300 comprises an intake chamber 302. FIG. 3*b* shows a side view of the intake chamber 302, FIG. 3*c* shows a front view of the intake chamber 302 and FIG. 3*d* shows a bottom view of the intake chamber 302.

Similar to the devices 100 and 200, the device 300 comprises an intake 102 and an outlet 104. The intake 102 may be part of the intake chamber 302, which encloses an inner volume that is in fluid communication with the outlet 104. The intake chamber 302 may for example comprise a metal such as aluminum and/or plastic such as polyvinyl chloride. The device 300 may further comprise a tube adapter 306, which is to connect the intake chamber 302 with a tube 308. An input of the tube adapter 306 may comprise an input connector that is to be connected with an outlet 310 of the intake chamber 302. An output of the tube adapter 306 may comprise an output connector that is to be connected to the tube 308. In one example, an input opening of the tube adapter 306 may have a larger cross-sectional area than an output opening of the tube adapter 306. The tube adapter 306 may for example comprise a metal such as aluminum and/or plastic such as polyvinyl chloride. In some examples, the tube adapter 306 may be made using 3D printing technology, e.g. from a thermoplastic such as polyamides or acrylonitrile butadiene styrene (ABS). The tube 308 is to connect the tube adapter 306 to the outlet 104. In some examples, the outlet 104 may be a part of the tube 308 or may be attached to the tube 308. The tube may e.g. comprise a rigid or flexible plastic. In some examples, the outlet 104 may be to receive a fan (not shown) that is to generate an air flow through the outlet 104, e.g. to extract air from the outlet 104. In other examples, the outlet 104 may be to receive another tube (not shown), which may e.g. be connected to a fan and/or may be part of an air extraction system. In yet another example, the device 300 may comprise a fan, which may e.g. be arranged along the air flow path 106 connected the intake 102 with the outlet 104.

The intake 102 comprises a proximal intake segment 102A and a distal intake segment 102B. Each of the proximal and distal intake segments 102A, 102B may comprise segments of different walls of the intake chamber 302. In the example of FIGS. 3*a*-3*d*, each of the proximal and distal intake segments 102A, 102B comprises a segment 102A-I and 102B-I, respectively, of a side wall of the intake chamber 302, e.g. a front side wall, and a segment 102A-II and 102B-II, respectively, of a bottom wall of the intake chamber 302.

The intake 102 may also comprise further intake segments, e.g. intake segments 102C and 102D, which may be arranged between the proximal intake segment 102A and the distal intake segment 102B as in the example of FIGS. 3*a*-3*d*. Each of the intake segments 102C and 102D may also comprise segments of different walls of the intake chamber 302, e.g. a segment 102C-I and 102D-I, respectively, of a side wall of the intake chamber 302 and a segment 102A-II and 102B-II, respectively, of a bottom wall of the intake chamber 302. The intake segments 102A-I to 102D-I may form a front intake 102-I and the intake segments 102A-II to 102D-II may form a bottom intake 102-II.

As shown in the front and bottom view of the intake chamber 302 in FIGS. 3*c* and 3*d*, respectively, each of the wall segments 102A-I to 102D-I and 102A-II to 102D-II has at least one hole. The opening ratio of the wall segments 102A-I to 102D-I and 102A-II to 102D-II may increase from the proximal intake segment 102A to the distal intake segment 102B. In some examples, each of the wall segments 102A-I to 102D-I and 102A-II to 102D-II may have a plurality of holes, and a density of holes may increase from the proximal intake segment 102A to the distal intake segment 102B. In one example, the opening ratio in the proximal intake segment 102A may be no smaller than 5% and/or no larger than 20%, e.g. 10%, the opening ratio in the intake segment 102C may be no smaller than 15% and/or no larger than 30%, e.g. 20%, the opening ratio in the intake segment 102D may be no smaller than 25% and/or no larger than 40%, e.g. 30%, and the opening ratio in the distal intake segment 102B may be no smaller than 35% and/or no larger than 50%, e.g. 40%. The opening ratio of the wall segments 102A-I to 102D-I may be different from the opening ratio of the respective wall segment of the wall segments 102A-II to 102D-II. In one example, the wall segment 102A-I on the front wall of the intake chamber 302 may e.g. have a larger opening ratio than the wall segment 102A-II on the bottom wall of the intake chamber 302. In some examples, the front intake 102-I may comprise a different number of intake segments than the bottom intake 102-II.

The wall segments 102A-I to 102D-I and/or the wall segments 102A-II to 102D-II may e.g. be formed integrally with the side wall and bottom wall, respectively, of the intake chamber 302, e.g. by cutting or drilling holes into the respective wall. In other examples, the wall segments 102A-I to 102D-I and/or the wall segments 102A-II to 102D-II may be replaceable plates, which may e.g. be to be mounted in corresponding openings of the side and bottom wall, respectively.

The intake chamber 302 may also comprise a support structure to removably attach an air filter (not shown) adjacent to the intake 102 similar to the device 200, e.g. pairs of rails 204, which may be arranged on walls of the intake chamber 302 adjacent to the intake segments 102A-102D. The intake camber 302 may for example comprise at least one pair of rails on each of the front side wall and the bottom wall. The support structure may be formed integrally with the intake chamber 302 or may be attached to the intake chamber 302.

Figure 4A:
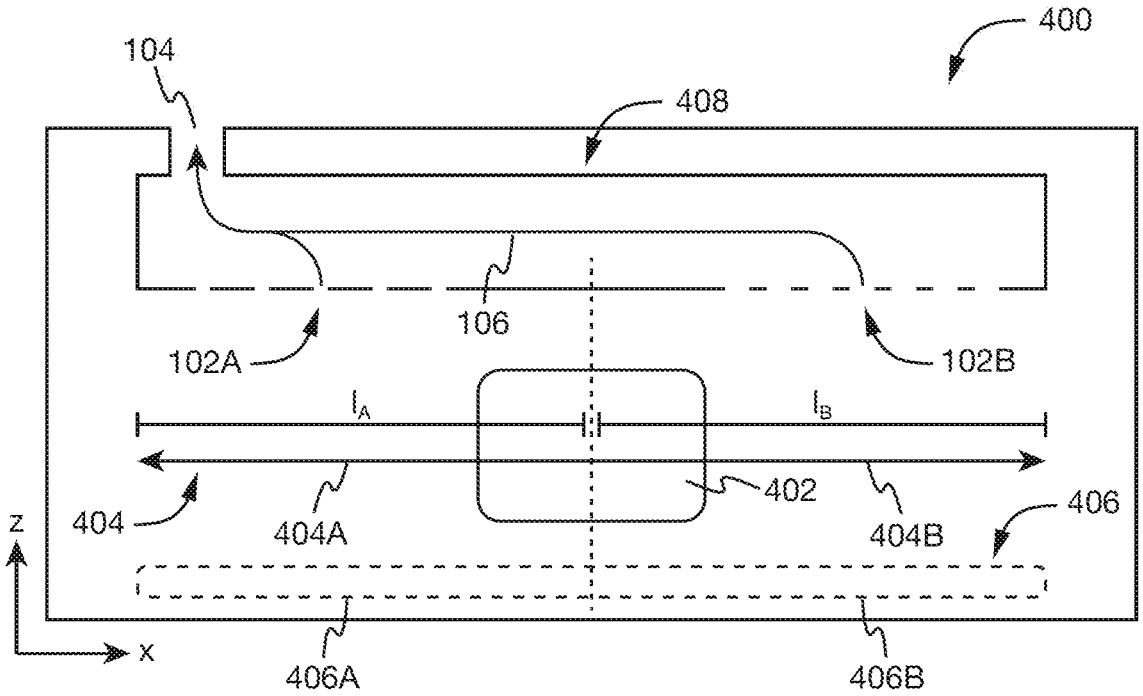
FIG. 4*a*: a front view of a printing device according to an example.
Figure 4B:
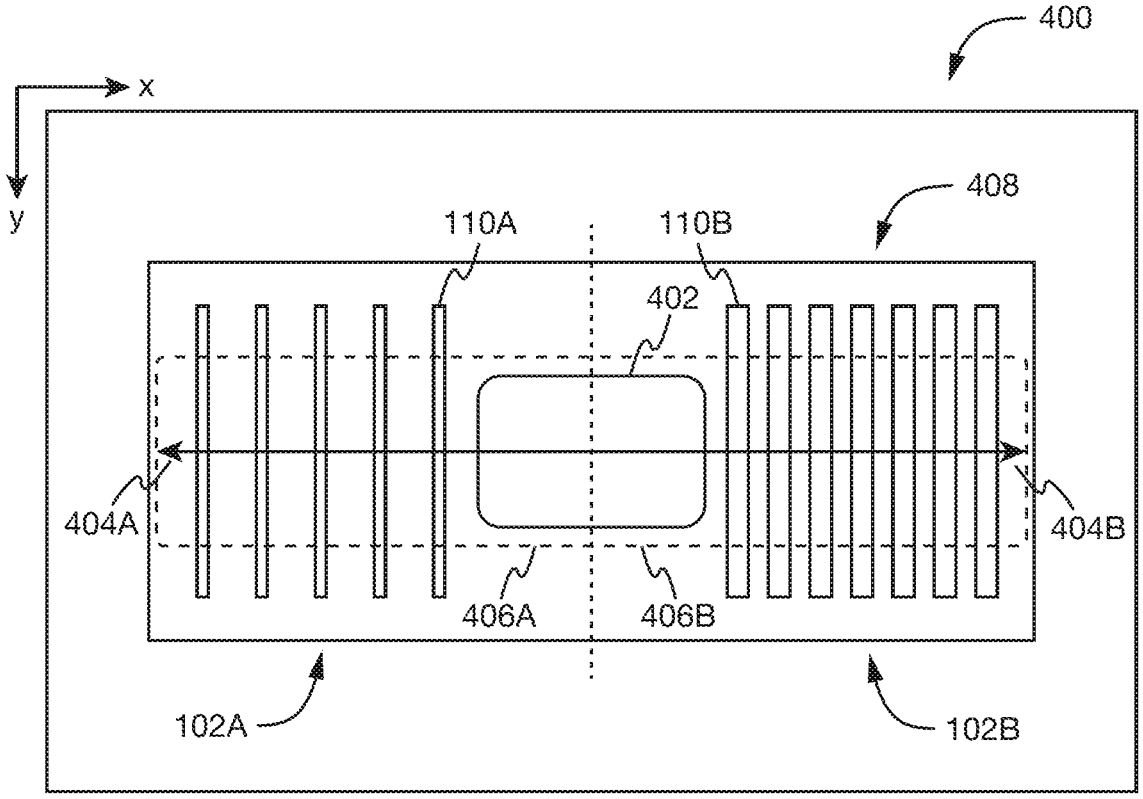
FIG. 4*b*: a bottom view of the printing device of FIG. 4*a* in accordance with an example.

FIGS. 4*a* and 4*b* show a front and bottom view, respectively, of a printing device 400 according to an example. The printing device 400 may for example be an ink-jet printer, e.g. a dye-sublimation textile printer. The printing device 400 comprises a print head carriage 402 that is movable along a print head path 404 across a printing zone 406. For this, the print head carriage 402 may for example be coupled to an actuator such as a worm drive or gear drive. The print head carriage 402 may be to receive a print head (not shown), e.g. as detailed below with reference to FIG. 5, wherein the print head may be to deposit a printing fluid like ink on a print medium (not shown) such as a paper or a textile arranged in the printing zone 406.

The printing device 400 further comprises an aerosol extractor 408, which may for example be similar to one of the devices 100, 200, and 300. The aerosol extractor 408 has an outlet 104 and an intake 102, which are connected by an air flow path 106. The intake 102 comprises a distal intake segment 102B and a proximal intake segment 102A that is arranged between the distal intake segment 102B and the outlet 104 along the air flow path 106. In other examples, the aerosol extractor 408 may comprise more than two intake segments, e.g. similar to the devices 200 and 300.

The intake 102 may be arranged adjacent to the print head path 404 and/or the printing zone 406, e.g. such that the intake 102 faces the printing zone 406. The outlet 104 may be in fluid communication with the environment of the printing device 400, e.g. such that air leaving the outlet 104 is released to the outside of the printing device 400. The outlet 104 may e.g. be arranged in or on an outer wall of the printing device 400. In some examples, the outlet 104 may be connected to an air extraction system, e.g. to extract air leaving the outlet 104 from a room that the printing device 400 is placed in. In other examples, the outlet 104 may be in fluid communication with the interior of the printing device 400, e.g. such that air leaving the outlet 104 is released to the inside of the printing device 400.

Each of the proximal and distal intake segments 102A, 102B comprises at least one opening 110A and 110B, respectively, that is in fluid communication with the outlet 104 of the aerosol extractor 408, e.g. through the air flow path 106. In the example of FIGS. 4*a* and 4*b*, the proximal and distal segments 102A, 102B each comprise a plurality of openings 110A and 110B, respectively. The openings 110A, 110B may for example have a quadratic, rectangular, circular, ellipsoid or irregular shape and may be arranged in a regular or irregular pattern. In some examples, the proximal and distal intake segments 102A, 102B may be similar to the proximal and distal intake segments of one of the devices 100, 200, and 300.

A proximal effective intake width of the proximal intake segment 102A is smaller than a distal effective intake width of the distal intake segment 102B. In the context of the present disclosure, the effective intake width of an intake segment may for example denote a ratio of an area of the at least one opening in the intake segment and a length of a portion of the print head path 404 associated with the intake segment. The portion of the print head path 404 associated with an intake segment may for example be a portion of the print head path 404 adjacent to the respective intake segment, e.g. the portion for which the respective intake segment is the closest intake segment. A portion of the print head path 404 may in turn be associated with a segment of the printing zone 406, e.g. a segment of the printing zone 406 adjacent to the portion of the print head path 404.

In the example of FIGS. 4*a* and 4*b*, a first portion 404A of the print head path 404 is associated with the proximal intake segment 102A and a second portion 404B of the print head path 404 is associated with the distal intake segment 102B. In the following, the first portion 404A may also be referred to as the proximal portion 404A of the print head path 404 and the second portion 404B may also be referred to as the distal portion 404B of the print head path 404. The proximal portion 404A may be closer to the proximal intake segment 102A than to the proximal intake segment 102B and the distal portion 404B may be closer to the distal intake segment 102B than to the proximal intake segment 102A as indicated by the dotted line in FIGS. 4*a* and 4*b*.

The proximal portion 404A may be associated with a first or proximal segment 406A of the printing zone 406. The proximal segment 406A may e.g. comprise a part of the printing zone 406 that is closer to the proximal portion 404A and/or the proximal intake segment 102A than to the distal portion 404B and/or the distal intake segment 102B. Accordingly, the distal portion 404B may be associated with a second or distal segment 406B of the printing zone 406. The distal segment 406B may e.g. comprise a part of the printing zone 406 that is closer to the distal portion 404B and/or the distal intake segment 102A than to the proximal portion 404A and/or the proximal intake segment 102A.

The proximal portion 404A may have a length $l_A$ and the distal portion 404B may have a length $l_B$. The total length l of the print head path 404 may for example be in the range of 0.5 m to 5 m, e.g. 3 m. The openings 110A in the proximal intake segment 102A may for example have a combined cross-sectional area $A_A$ and the openings 110B in the distal intake segment 102B may for example have a combined cross-sectional area $A_B$. Accordingly, the proximal effective intake width may be $w_A=A_A/l_A$ and the distal effective intake width may be $w_B=A_B/l_B$.

When extracting air from the outlet 104, e.g. by connecting a fan or an air extraction system to the outlet 104 as described above with reference to FIGS. 3*a*-3*d*, a pressure difference across the distal intake segment 102B may be smaller than a pressure difference across the proximal intake segment 102A, e.g. due to the longer length of the respective air flow path. By choosing the proximal effective intake width smaller than the distal effective intake with, i.e. $w_A<w_B$, this difference in the pressure difference may be compensated at least in part such as to achieve comparable flow rates, area-normalized flow rates and/or length-normalized flow rates through the proximal and distal intake segments 102A, 102B. In some examples, a flow rate, an area-normalized flow rate and/or a length-normalized flow rate through the distal intake segments 102B may be no smaller than 75% and/or no larger than 125% of the corresponding quantity for the proximal intake segment 102A, in one example no smaller than 90% and/or no larger than 110% of the corresponding quantity for the proximal intake segment 102A. The length-normalized flow rate of an intake segment may e.g. be the flow rate of the intake segment divided by the length of the associated portion of the print head path 404. The area-normalized flow rate of an intake segment may e.g. be the flow rate of the intake segment divided by the area of the associated segment of the printing zone 406. The effective intake widths $w_A$, $w_B$ may e.g. be chosen based on the respective pressure difference and/or air flow path length as described above for the opening ratio of the device 100.

In some examples, a length of the intake 102 may be at least 75%, in one example at least 100%, of the length l of the print head path 404 in the printing zone 406. In one example, the length of the intake 102 may be as long as or longer than the length l of the print head path 404 in the printing zone 406. The length of the intake 102 may for example be the distance between the two outermost intake segments on opposite sides of the intake 102, e.g. between the outermost openings or the outer edges of the outermost intake segments. Additionally or alternatively, a length of the intake 102 may be at least 75%, in one example at least 100%, of a width of a print medium for use with the printing device 400, e.g. a maximum print medium width accepted by the printing device 400.

As described above with reference to FIGS. 3*a*-3*d*, the outlet 104 may be to receive a fan (not shown) that is to generate an air flow through the outlet 104 or may be to receive a tube (not shown), which may e.g. be connected to a fan and/or may be part of an air extraction system. In other examples, the printing device 400 may comprise a fan (not shown), which may e.g. be mounted adjacent to the outlet 104.

Figure 5A:
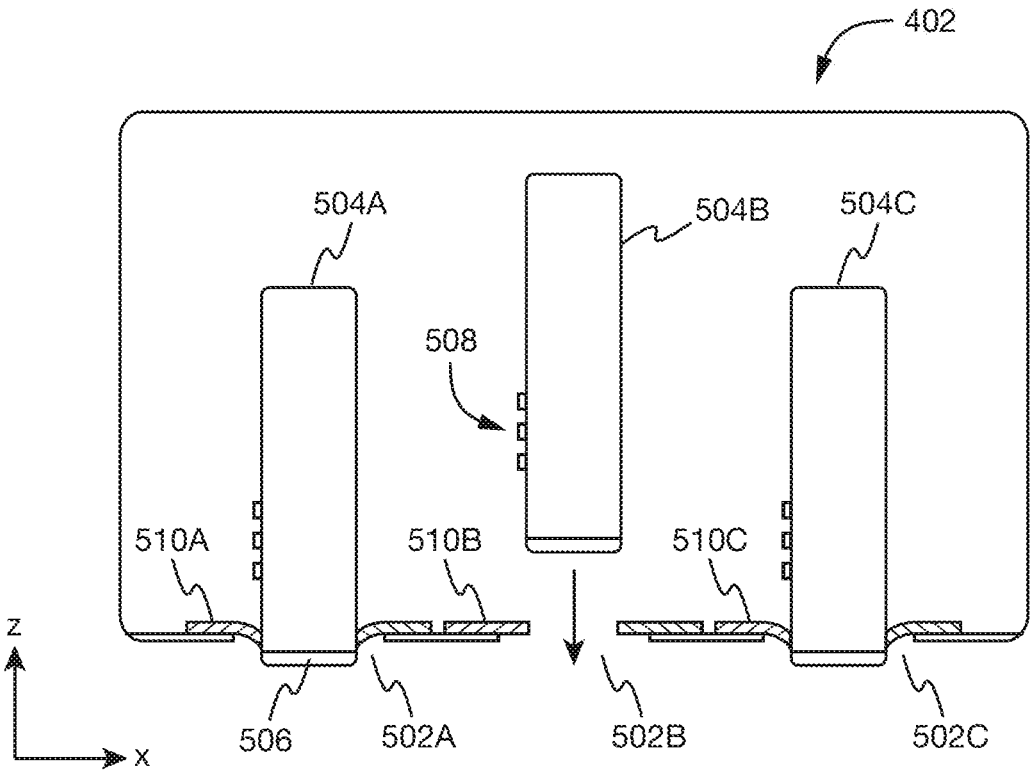
FIG. 5*a*: a front view of a print head carriage of a printing device according to an example.
Figure 5B:
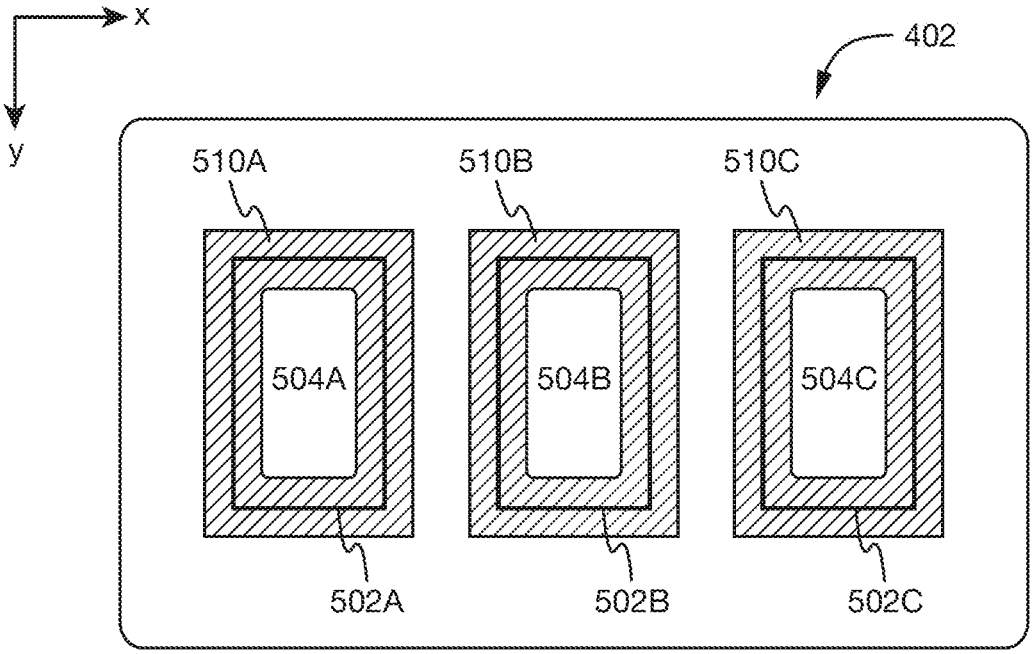
FIG. 5*b*: a bottom view of the print head carriage of FIG. 5*a* in accordance with an example.

FIGS. 5*a* and 5*b* illustrate a print head carriage 402 of a printing device according to an example in front and bottom view, respectively. The print head carriage 402 of FIGS. 5*a*, 5*b* may for example be part of or employed in one of the printing devices 400 and 600. The print head carriage 402 may be to receive a print head that is to be mounted in the print head carriage 402, e.g. the print heads 504A, 504B, 504C. The print head carriage 402 and/or the print head may further comprise a flexible sealing structure that is in contact with the print head and the print head carriage 402 when the print head is mounted in the print head carriage 402.

In the example of FIGS. 5*a* and 5*b*, the print head carriage 402 comprises openings 502A, 502B, and 502C, which may e.g. be arranged in a bottom plate of the print head carriage 402. Each of the openings 502A-502C may be to receive a nozzle plate 506 of one of the print heads 504A-504C. Each of the openings 502A-502C may be surrounded by a flexible sealing structure 510A, 510B, and 510C, respectively, which may e.g. be attached to an upper rim of the respective opening. The flexible sealing structures 510A-510C may e.g. comprise silicone or natural or synthetic rubber. As illustrated in FIG. 5*a*, a sealing structure 510A-510C may come in contact with a print head 504A-504C when the print head 504A-504C is inserted into the respective opening 510A-510C. This may cause the flexible sealing structure 510A-510C to bend, which may provide a tight seal while at the same time reducing a force to be applied for inserting the print head 504A-504C. The sealing structures 504A-504C may prevent aerosol from entering the print head carriage 402 through the openings 502A-502C and may thus prevent aerosol from being deposited on electric contacts 508 of the print head carriage 404 and/or the print heads 504A-504C.

Figure 6A:
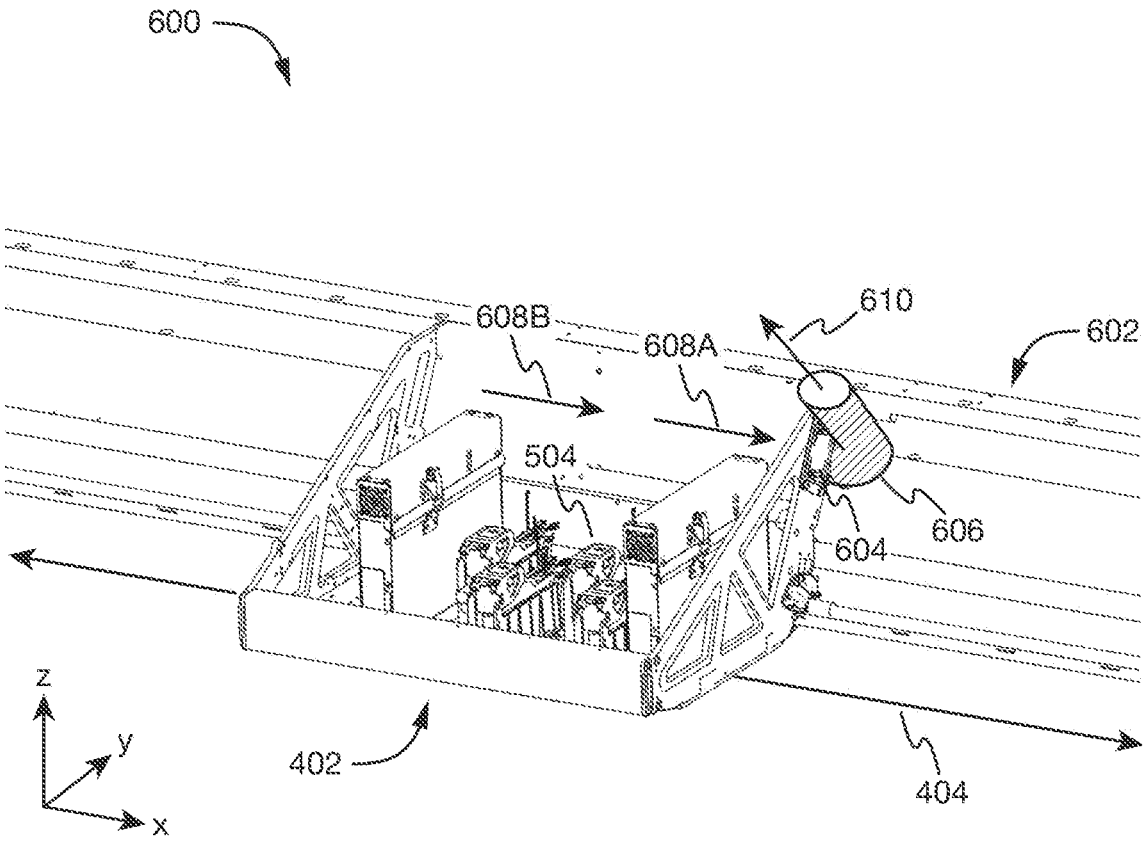
FIG. 6*a*: a perspective view of a print head carriage of a printing device in accordance with an example.
Figure 6B:
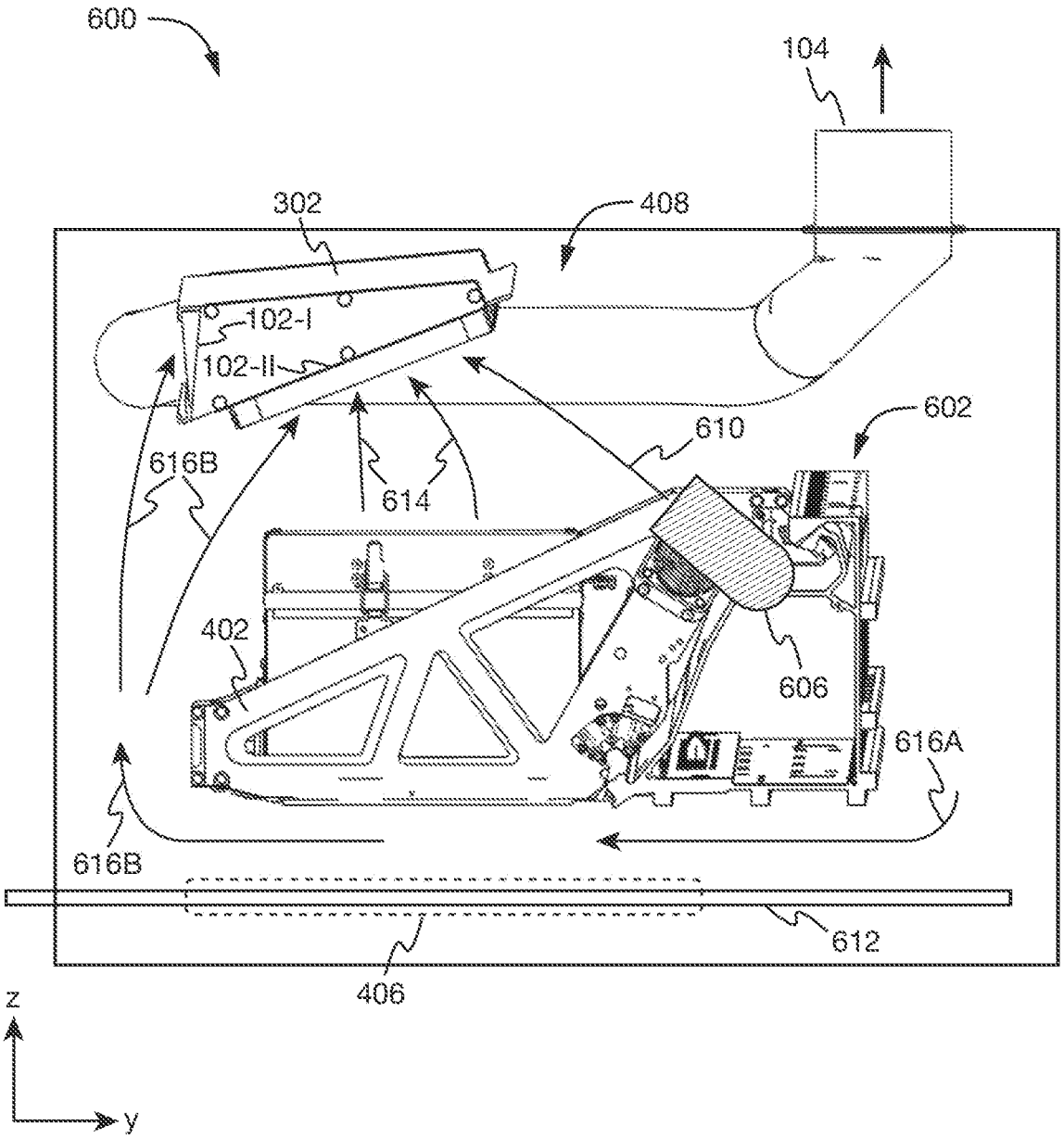
FIG. 6*b*: a side view of the printing device of FIG. 6*a* in accordance with an example.

FIGS. 6*a* and 6*b* depict a printing device 600 in accordance with another example. FIG. 6*a* shows a perspective view of a print head carriage 402 of the printing device 600, whereas FIG. 6*b* shows a side view of the printing device boo.

The print device 600 may for example be similar to the printing device 400 discussed above. The printing device 600 also comprises a print head carriage 402 that is movable along a print head path 404 across a printing zone 406 and an aerosol extractor 408 having an intake 102 and an outlet 104 connected by an air flow path.

The print head carriage 402 may be mounted on a rail 602 for moving the print head carriage 402 along the print head path 404, wherein the rail 602 may e.g. also comprise an encoder strip (not shown) to control the position of the print head carriage 402. The print head carriage 402 may for example be similar to the print head carriage 402 of FIG. 5. The printing device 600 may also comprise a print head 504 that is to be mounted in the print head carriage 402 and a flexible sealing structure (not shown) that is in contact with the print head 504 and the print head carriage 402 when the print head 504 is mounted in the print head carriage 402. The print head 504 may be to deposit a printing fluid on a print medium 612, which may e.g. be moved along a media advance direction through the printing zone 406. In one example, the printing device 600 may be a large-format textile printer and the printing fluid may e.g. be a dye-sublimation ink.

The print head carriage 402 may further comprise a tube section 606 with an outlet that faces the intake 102 of the aerosol extractor 408 when the print head carriage 402 is arranged in the printing zone 406. The tube section 606 may be to direct an air flow 608 generated by the print head carriage 402 towards the intake 102 of the aerosol extractor 408, e.g. to convert the air flow 608 into an air flow 610 flowing towards the intake 102. The tube section 606 may for example be "L"-shaped, e.g. such that an inlet of the tube section 606 faces in the direction of the print head path 404 and the outlet of the tube section 606 faces in a direction perpendicular to the print head path 404. The print head carriage 402 may for example comprise a fan 604 that is to generate an air flow 608A, e.g. to cool electronic components in the print head carriage 402. The inlet of the tube section 606 may face the fan 604 along a flow path of the air flow 608A generated by the fan 604. The air flow 608A may flow along the flow path from the fan 604 to the inlet of the tube section 606. In some examples, the inlet of the tube section 606 may be attached to the fan 604 as shown in FIG. 6*a*. Additionally or alternatively, an air flow 608B may be generated by the movement of the print head carriage 402 and the tube section 606 may be to direct the air flow 608B towards the intake 102.

The aerosol extractor 408 may for example be similar to the device 300 shown in FIGS. 3*a*-3*d*. Accordingly, the intake 102 may comprise an intake chamber 302 with a front intake 102-I and a bottom intake 102-II formed by a plurality of intake segments including a proximal intake segment (not shown) and a distal intake segment (not shown). In other examples, the aerosol extractor 408 may e.g. be similar to the device 100 or 200.

When air is extracted through the outlet 104, which may e.g. be arranged on an outer wall of the printing device 600, air may be drawn from the interior of the printing device through the intake 102, which may generate additional air flows 614 towards the intake 102. Air flows 610 and 614 may pass through the intake 102 at least in part and may subsequently flow along the air flow path towards the outlet 104. This may allow for extracting aerosol from the printing device 600. The aerosol may be absorbed by filters (not shown) in the aerosol extractor 408, e.g. filters mounted in front of the intake 102 as described above with reference to FIGS. 2*a* and 2*b*.

The printing device 600 may further comprise a heater (not shown) that is to generate a flow 616A of heated air across the print medium 612. The heated air flow 616A may e.g. pass above the printing zone 406 between the print head carriage 402 and the print medium 612. The heated air flow 616A may e.g. assist in drying printing fluid deposited on the print medium 612. The printing device 600 may be to direct the heated air flow 616A towards the intake 102 of the aerosol extractor 408, e.g. to re-direct the heated air flow 616A to an air flow 618B flowing towards the front and/or bottom intake 102-I, 102-II. Air flow 616B may pass through the intake 102 at least in part.

Figure 7:
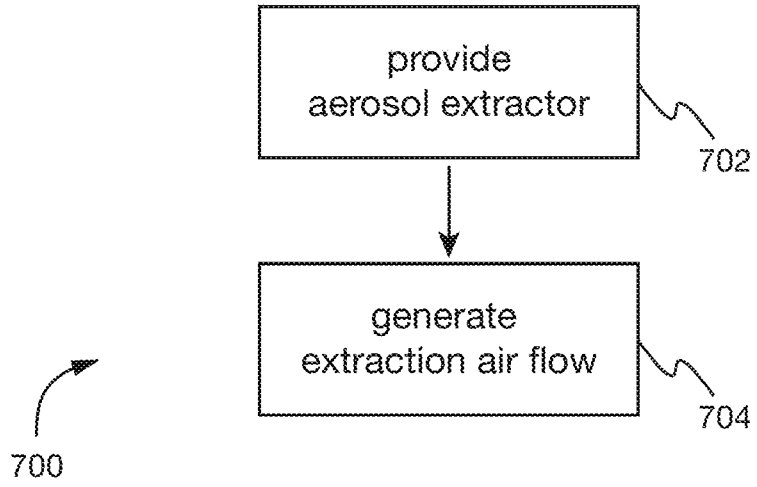
FIG. 7: a method of operating a printing device according to an example.

FIG. 7 depicts a flowchart of a method 700 of operating a printing device in accordance with an example. The method 700 may for example be executed with the printing device 400 and will be described in the following with reference to FIGS. 4*a*, 4*b* and 7. This is, however, not intended to be limiting in any way, and the method 700 may also be executed with other printing devices, for example the printing device 600.

The method 700 comprises, at block 702, providing an aerosol extractor 408 having an outlet 104 and an intake 102, wherein the intake 102 has a first intake segment 102A adjacent to a first segment 406A of a printing zone 406 of the printing device 400 and a second intake segment 102B adjacent to a second segment 406B of the printing zone 406. In some examples, the aerosol extractor provided in block 702 may be similar to one of the devices 100, 200, and 300.

The first and second segments 406A, 406B of the printing zone 406 have the same area and may e.g. be segments of the printing zone 406 adjacent to the center of the respective intake segment. In some examples, the first and second segments 406A, 406B may be the segments of the printing zone 406 for which the respective intake segment is the closest intake segment or may be a part of the segments of the printing zone 406 for which the respective intake segment is the closest intake segment. The first and second segments 406A, 406B may e.g. be segments of the printing zone 406 associated with the portions 404A, 404B of the print head path 404 as described above with reference to FIGS. 4*a*, 4*b*.

Each of the first and second intake segments 102A, 102B comprises at least one opening that is in fluid communication with the outlet 104 of the aerosol extractor 408, e.g. via the air flow path 106. The first and second intake segments 102A, 102B differ in at least one of a size of an opening, a density of openings or an arrangement of openings, e.g. as described above with reference to FIGS. 1, 2 and 4. The first and second intake segments 102A, 102B may e.g. have a different opening ratio and/or a different effective intake width.

The method 700 further comprises, at block 704, generating an air flow through the intake 102 of the aerosol extractor 408 to the outlet 104, which may also be referred to as extraction air flow. The extraction air flow may for example by generated with a fan, which may e.g. be part of the printing device 400 or may be provided as part of the method 700, e.g. by attaching the fan or a tube connected thereto to the outlet 104. Block 704 may also comprise maintaining the extraction air flow, e.g. continuously during a print job of the printing device 400 or for a predetermined amount of time, which may e.g. be no less than 5 seconds and/or no more than 1 minute. Block 704 may additionally comprise filtering the extraction air flow, e.g. using filters arranged along the air flow path and/or adjacent to the intake 102 and/or the outlet 104. The extraction air flow may be released from the printing device 400 through the outlet 104 or may be released into the interior of the printing device 400.

A fraction of the air flow from the first segment 406A of the printing zone 406 is between 75% and 125% of a fraction of the air flow from the second segment 406B of the printing zone 406. To achieve such a homogeneous air flow, the size of an opening, the density of openings or the arrangement of openings in the first and/or second intake segment 102A, 102B may be have been adjusted accordingly, e.g. prior to execution of the method 700. In some examples, the fraction of the air flow from the first segment 406A of the printing zone 406 may be no smaller than 90% and/or no larger than 110% of the fraction of the air flow from the second segment 406B of the printing zone 406. Each of the first and second segments 406A, 406B may for example cover no less than 10% and/or no more than 50% of the printing zone 406, in one example no less than 25% and/or no more than 50% of the printing zone 406. In some examples, a distance between outer edges of the first and second segments 406A, 406B may be at least 75%, in one example at least 90%, of a length of the printing zone 406, e.g. at least 75% of the printing zone 406 are covered by the first and second segments 406A, 406B and segments of the printing zone 406 in between the first and second segments 406A, 406B.

In other examples, an aerosol extractor with more than two intake segments may be provided, e.g. an aerosol extractor similar to the device 200 or 300. The intake 102 may for example additionally comprise a third intake segment 102C adjacent to a third segment of the printing zone 406. The third segment of the printing zone may have the same area as the first second segments 406A, 406B and may comprise at least one opening 110C that is in fluid communication with the outlet 104 of the aerosol extractor 408. The third intake segment may differ from the first and/or second intake segments 102A, 102B in at least one of a size of an opening, a density of openings or an arrangement of openings. In this example, a fraction of the air flow generated in block 704 from the third segment of the printing zone 406 may for example be no less than 75% and/or no more than 125% of the fraction of the air flow from the second segment 406B of the printing zone 406. The third segment may for example cover no less than 5% and/or no more than 33% of the printing zone 406, in one example no less than 20% and/or no more than 33% of the printing zone 406. In some examples, at least 75% of the printing zone 406 are covered by the first, second and third segments and segments of the printing zone 406 in between the first, second and third segments.

Figure 8:
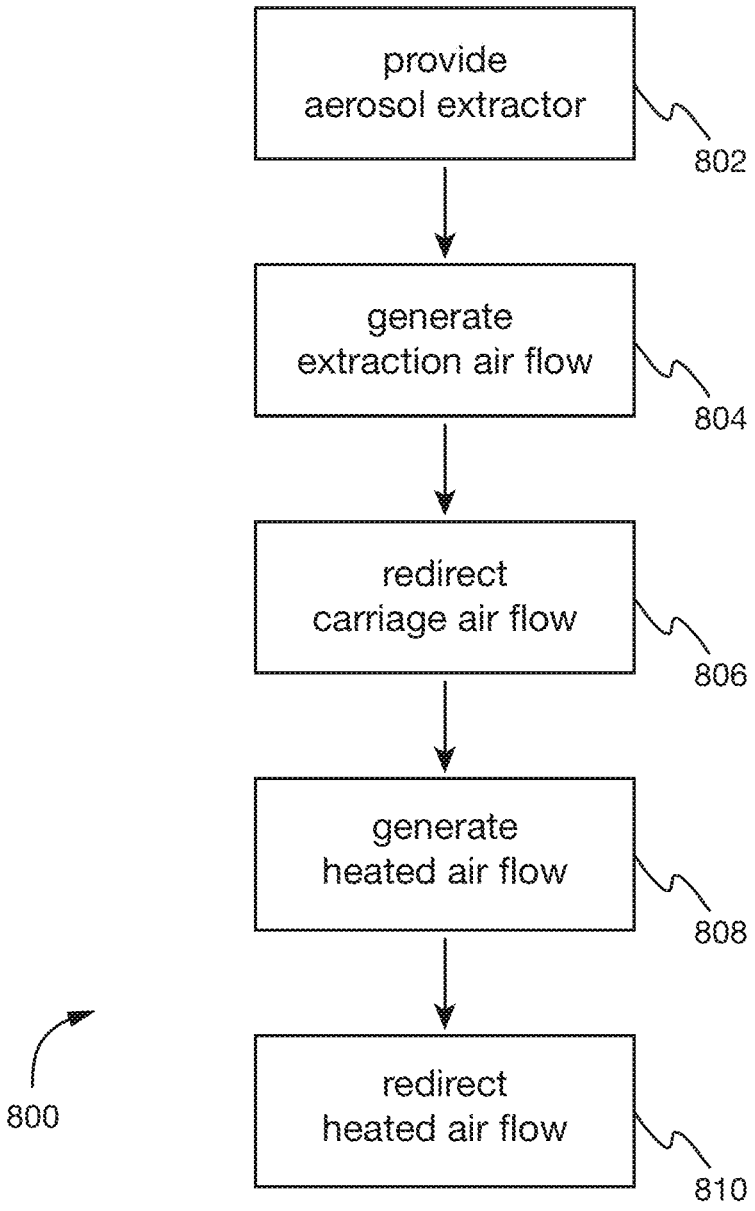
FIG. 8: another method of operating a printing device in accordance with an example.

FIG. 8 depicts a flowchart of a method 800 of operating a printing device according to another example. The method 800 may for example be executed with the printing device 600 and will be described in the following with reference to FIGS. 6*a*, 6*b* and 8. This is, however, not intended to be limiting in any way, and the method 800 may also be executed with other printing devices, for example the printing device 400. Furthermore, the flowchart in FIG. 8 does not imply a certain order of execution of the method 800. As far as technically feasible, different blocks of the method 800 may be executed in an arbitrary order and/or may be executed simultaneously at least in part.

The method 800 comprises, at block 802, providing an aerosol extractor 408 having an outlet 104 and an intake 102, e.g. as in block 702 of method 700. The method 800 further comprises, at block 804, generating an air flow through the intake 102 of the aerosol extractor 408 to the outlet 104, e.g. as in block 704 of method 700.

The method 800 may further comprise, at block 806, directing an air flow 608 generated by a print head carriage 402 of the printing device 600 towards the intake 102 of the aerosol extractor 408. The air flow 608 generated by the print head carriage 402, also referred to as carriage air flow 608, may for example be directed towards the intake 102 using the tube section 606 as described above with reference to FIG. 6*a*. Block 806 may also comprise generating a cooling air flow 608A for the print head carriage 402, e.g. using the fan 604, and/or directing the cooling air flow 608A towards the intake 102. Block 806 may also comprise generating a movement air flow 608B, e.g. by moving the print head carriage 402, and/or directing the movement air flow 608B towards the intake 102. Block 806 may further comprise taking up the air flow 608 through the intake 102 at least in part, e.g. by taking up the re-directed air flow 610 through the intake 102 at least in part.

The method 800 may further comprise, at block 808, generating a heated air flow 616A above a print medium 612 in the printing zone 406. The heated air flow may for example be generated using the heater of the printing device 600, which may e.g. comprise a heating element and a fan. The heated air flow 616A may for example be generated such that the heated air flow 616A passes between the print medium 612 in the printing zone 406 and the print head carriage 402 as illustrated in FIG. 6*b*. A temperature of the heated air flow may be adapted to a printing fluid and/or the print medium. In some examples, the printing fluid may be a dye-sublimation ink and the temperature of the heated air flow may be larger than a sublimation temperature of the printing fluid. The temperature of the heated air flow may for example be no less than 50° C. and/or no more than 250° C., e.g. no less than 150° C. and/or no more than 200° C.

The method 800 may also comprise, at block 810, directing the heated air flow 616A towards the intake 102 of the aerosol extractor 408. This may comprise directing the heated air flow 616A towards a wall of the printing device 600 and/or a deflection element such as a tilted plate to convert the heated air flow 616A to an air flow 616B flowing towards the intake 102, e.g. the front and bottom intakes 102-I, 102-II. Block 810 may further comprise taking up the heated air flow 616 through the intake 102 at least in part, e.g. by taking up the air flow 616B through the intake 102 at least in part.

The description is not intended to be exhaustive or limiting to any of the examples described above. The device, the printing device, and the method of operating a printing device disclosed herein can be implemented in various ways and with many modifications without altering the underlying basic properties.

The invention claimed is:

1. A device with an air flow path extending from an intake to an outlet, wherein:

the intake is to be mounted in a printing device;

the intake comprises a proximal intake segment and a distal intake segment along the air flow path, wherein a proximal air flow path from the proximal intake segment to the outlet is shorter than a distal air flow path from the distal intake segment to the outlet;

each of the proximal and distal intake segments comprises a wall segment with at least one hole; and an opening ratio of an area of the at least one hole and an area of the respective wall segment is larger in the distal intake segment than in the proximal intake segment.

2. The device of claim 1, wherein the opening ratios in the proximal and distal intake segments are chosen such that, when air is extracted through the outlet, a flow rate through the distal intake segment is between 75% and 125% of a flow rate through the proximal intake segment.

3. The device of claim 1, wherein:

the intake further comprises a central intake segment comprising a wall segment with at least one hole, a central air flow path from the central intake segment to the outlet is shorter than the distal air flow path and longer than the proximal air flow path; and an opening ratio of an area of the at least one hole and an area of the wall segment in the central intake segment is larger than in the proximal intake segment and smaller than in the distal intake segment.

4. The device of claim 1, further comprising an intake chamber enclosing an inner volume, wherein:

the outlet is in fluid communication with the inner volume; and each of the proximal and distal intake segments comprises a segment of a bottom wall of the intake chamber and a segment of a side wall of the intake chamber.

5. The device of claim 1, wherein each of the proximal and distal intake segments comprises a plurality of holes, and a density of holes is higher in the distal intake segment than in the proximal intake segment.

6. The device of claim 1, further comprising a support structure to removably attach an air filter adjacent to the intake.

7. A printing device comprising:

a print head carriage movable along a print head path across a printing zone; and an aerosol extractor having an outlet and an intake connected by an air flow path, the intake comprising a distal intake segment and a proximal intake segment arranged between the distal intake segment and the outlet along the air flow path, wherein each of the proximal and distal intake segments comprises at least one opening that is in fluid communication with the outlet of the aerosol extractor; and a proximal effective intake width of the proximal intake segment is smaller than a distal effective intake width of the distal intake segment, wherein the effective intake width of an intake segment is the ratio of an area of the at least one opening in the intake segment and a length of a portion of the print head path associated with the intake segment.

8. The printing device of claim 7, wherein a length of the intake is at least 75% of a length of the print head path in the printing zone.

9. The printing device of claim 7, further comprising:

a print head that is to be mounted in the print head carriage; and a flexible sealing structure that is in contact with the print head and the print head carriage when the print head is mounted in the print head carriage.

10. The printing device of claim 9, wherein the flexible sealing structure surrounds an opening in a bottom plate of the print head carriage that is to receive a nozzle plate of the print head and wherein the flexible sealing structure is to seal off the opening when the print head is arranged in the opening.

11. The printing device of claim 7, wherein the print head carriage further comprises a tube section with an outlet facing the intake of the aerosol extractor when the print head carriage is arranged in the printing zone.

12. The printing device of claim 11, wherein the print head carriage further comprises a fan that is to generate an air flow; and an inlet of the tube section faces the fan along a flow path of the air flow generated by the fan.

13. A method of operating a printing device, the method comprising:

providing an aerosol extractor having an outlet and an intake with a first intake segment adjacent to a first segment of a printing zone of the printing device and a second intake segment adjacent to a second segment of the printing zone, wherein the first and second segments of the printing zone have the same area, each of the first and second intake segments comprises at least one opening that is in fluid communication with the outlet of the aerosol extractor and the first and second intake segments differ in at least one of a size of an opening, a density of openings or an arrangement of openings; and generating an air flow through the intake of the aerosol extractor to the outlet, wherein a fraction of the air flow from the first segment of the printing zone is between 75% and 125% of a fraction of the air flow from the second segment of the printing zone.

14. The method of claim 13, further comprising directing an air flow generated by a print head carriage of the printing device towards the intake of the aerosol extractor.

15. The method of claim 13, further comprising generating a heated air flow above a print medium in the printing zone and directing the heated air flow towards the intake of the aerosol extractor.

* * * * *